US007334964B1

(12) United States Patent
Brown, Sr. et al.

(10) Patent No.: US 7,334,964 B1
(45) Date of Patent: Feb. 26, 2008

(54) COMBINATION ASPHALT FINISHING MACHINE

(76) Inventors: Freddie Lee Brown, Sr., 3011 Dixie Barwick Rd., Dixie, GA (US) 31629; Freddie Lee Brown, Jr., 3011 Dixie Barwick Rd., Dixie, GA (US) 31629

( * ) Notice: Subject to any disclaimer, the term of this patent is extended or adjusted under 35 U.S.C. 154(b) by 0 days.

(21) Appl. No.: 11/724,397

(22) Filed: Mar. 15, 2007

(51) Int. Cl.
*E01C 19/26* (2006.01)

(52) U.S. Cl. ..... 404/126; 404/128

(58) Field of Classification Search ..... 404/122, 404/123, 125, 126, 128, 130
See application file for complete search history.

(56) References Cited

U.S. PATENT DOCUMENTS 2,114,412 A * 4/1938 Wilson et al. ..... 404/123
2,721,405 A * 10/1955 Gardner ..... 172/784
2,755,713 A * 7/1956 Harrison ..... 404/123
2,775,925 A * 1/1957 Greiner ..... 404/123
2,830,511 A * 4/1958 Wills et al. ..... 404/86
2,878,731 A * 3/1959 Kressin ..... 404/85
3,302,540 A * 2/1967 Fuentes, Jr. ..... 404/127
4,878,544 A * 11/1989 Barnhart ..... 172/40
4,913,584 A * 4/1990 Garner et al. ..... 404/123
4,964,754 A * 10/1990 Garner et al. ..... 404/123
6,354,761 B1 * 3/2002 Clements ..... 404/129

* cited by examiner

*Primary Examiner*—Gary S. Hartmann
(74) *Attorney, Agent, or Firm*—Robert C. Brown

(57) ABSTRACT

A combination compacting and smoothing asphalt finishing machine comprising primary finishing elements which may be either compacting tires or smoothing rollers. The primary elements are driven and steered by engine and hydraulic mechanisms conventionally. The machine further comprises secondary asphalt finishing elements which complement the primary elements, being either smoothing rollers or ganged rubber tires. The secondary elements are pivotably attached to the frame of the machine. In a first position, the secondary elements are not in contact with the asphalt layer or with the primary elements and the weight of the machine is borne only by the primary elements. The secondary elements are hydraulically actuable and may be pivoted into a second position wherein only the secondary elements are in contact with the asphalt layer and are in driving contact with the primary elements which are thus raised from contact with the asphalt layer.

14 Claims, 2 Drawing Sheets

COMBINATION ASPHALT FINISHING MACHINE

TECHNICAL FIELD

The present invention relates to equipment for asphalt paving; more particularly, to paving equipment having rubber tires for compacting a layer of hot asphalt, and to paving equipment having steel rollers for smoothing a layer of hot asphalt; and most particularly, to a combination compacting and smoothing asphalt finishing machine wherein rubber tires and steel rollers may be used alternatively for compaction and smoothing, respectively, of the hot asphalt layer.

BACKGROUND OF THE INVENTION

Paving of roads and parking lots with asphalt is a mature prior art. Typically, asphalt paving medium (referred to herein as "asphalt") is prepared in a batch plant wherein a crushed stone aggregate is mixed with a hot tar preparation, yielding a highly viscous slurry of aggregate in tar that can be poured or laid in a layer onto a designated paving surface and then worked by specialized equipment to provide a durable surface for vehicular traffic when cool.

Hot asphalt, as it comes from the plant and is laid in a layer, contains significant amounts of entrained air and is in a non-compressed state. Thus paving comprises at least three distinct steps: a) laying the asphalt slurry in a layer of approximately the final thickness and lateral distribution; and finishing the layer by b) compacting the layer to remove air and ensure compaction into any depressions in the underlying substrate surface, and c) final smoothing of the compacted layer.

Once the designated surface is prepared to receive the asphalt, the first step of laying the asphalt is typically carried out by a laying machine that receives sequential batches of hot asphalt from delivery trucks and dispenses a continuous ribbon of the material while moving along the surface to be paved. In irregular areas such as parking lots, the distribution may be augmented manually by workers with shovels and/or screeds.

The second step of compacting the asphalt typically is carried out by a compacting machine that travels on one or more sets of smooth-surface, ganged rubber tires and that propels itself along the freshly-laid layer of hot asphalt. The tires are independently suspended in pairs such that the gangs of tires may follow the contours of the underlying surface to compact the asphalt in surface depressions as well as in the higher surface areas. This is an important step in assuring a long-wearing finished surface; failure to compact the material properly in depressions can result in development of potholes and premature failure of the finished layer.

The third step of smoothing the asphalt typically is carried out by a smoothing machine that travels on one or more smooth-surface steel rollers and that propels itself along the freshly-compacted layer of hot asphalt. The steel rollers work the compacted asphalt both forwardly and laterally to eliminate depressions and thus provide an overall even layer. In addition, the steel rollers intensely compact the upper part of the layer to impart a very fine-grained surface finish to the layer.

After the smoothing operation, the finished asphalt layer is allowed to cool and solidify, preferably before vehicular traffic is allowed onto the surface.

A shortcoming of the prior art is that two separate finishing machines are required for compacting and smoothing, respectively. These prior art machines, while very similar in overall construction and operation, are equipped with rubber tires and steel rollers, respectively. Each machine, even modest versions thereof, may cost in excess of $100,000, making ownership of both such machines prohibitive for many smaller paving companies; instead, one or both machines typically is/are rented for specific paving jobs, which entails rental fees, and coordinating rental and construction schedules, and machine transportation to and from the paving site. Further, as a paving business grows and the purchase of paving machines becomes feasible, each additional increment of production capacity requires the purchase of two finishing machines, one of each type.

What is needed in the art is an improvement whereby only one compacting and smoothing finishing machine is required for a paving operation.

It is a principal object of the present invention to reduce the cost of buying or renting finishing machines for an asphalt paving contractor.

It is a further object of the invention to simplify the logistics and reduce the cost of a paving operation.

SUMMARY OF THE INVENTION

Briefly described, a combination compacting and smoothing finishing machine in accordance with the invention comprises one or more primary finishing elements which may be either compacting tires or smoothing rollers. The primary finishing elements are driven and steered by engine and hydraulic mechanisms as in the prior art. The machine further comprises one or more secondary finishing elements which are complementary to the primary elements, being either smoothing rollers or ganged rubber tires. The secondary finishing elements are pivotably attached to the frame of the machine. In a first position, the secondary elements are not in contact with the asphalt layer or with the primary elements and the weight of the machine is borne only by the primary elements. The secondary elements are hydraulically actuable and may be pivoted into a second position wherein only the secondary elements are in contact with the asphalt layer and are in driving contact with the primary elements which are thus raised from contact with the asphalt layer.

Such a machine may be fabricated as an entirely new assembly or may be a retrofit of a prior art single-function compacting or smoothing machine.

Thus, a combination finishing machine in accordance with the invention may function, interchangeably and with equal facility, as either a compacting machine or a smoothing machine.

BRIEF DESCRIPTION OF THE DRAWINGS

The present invention will now be described, by way of example, with reference to the accompanying drawings, in which.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

The advantages and benefits of a combination asphalt compacting and smoothing finishing machine in accordance with the invention may be better appreciated by first considering a prior art compacting or finishing machine.

Figure 1:
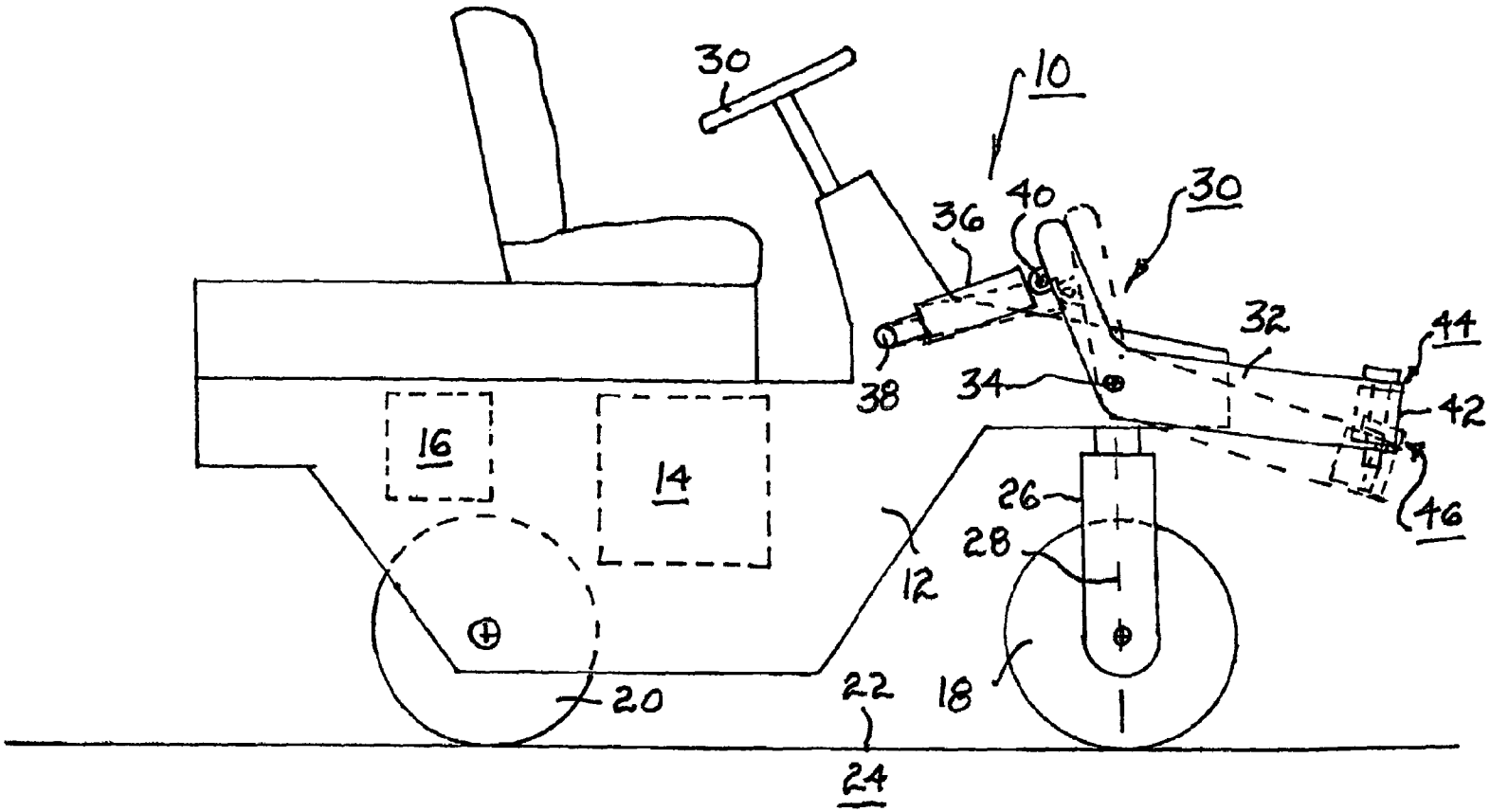
FIG. 1 (PRIOR ART)
FIG. 1 is an elevational side view of a prior art finishing machine, which may be either a compacting machine or a smoothing machine.

Referring to FIG. 1, a prior art asphalt compacting or finishing machine 10 comprises a chassis 12 supporting a motive engine 14 and a hydraulic system 16 driven by engine 14. Chassis 12 is borne upon at least one front rollable element ("front element") 18 and at least one rear rollable element ("rear element") 20 for rolling along a surface 22 of a layer 24 of hot asphalt composition. Typically, front element 18 is steerable by being supported in a suspension fork 26 pivotably connected to chassis 12 about a turning axis 28 and connected to a steering wheel 30 via a steering mechanism (not shown) which may be hydromechanical. Typically, only rear element 20 is motively driven by engine 14 although in some types of prior art machine 10 both the front and rear elements are driven.

A prior art machine 10 typically includes a hydraulic lifting mechanism 30 mounted on a forward portion of chassis 12 which may comprise a lifting arm 32 that is conveniently formed as a bellcrank, a pivot 34 for lifting arm 32, and a hydraulic cylinder 36 pivotably mounted at a first end 38 on chassis 12 and pivotably connected to lifting arm 32 at a second end 40. The outer end 42 of lifting arm 32 is thus radially pivotable about pivot 34 by hydraulic cylinder 36 between a raised position 44 and a lowered position 46.

When prior art machine 10 is a compacting machine, front element 18 and rear element 20 each comprise a plurality of smooth-surfaced rubber tires that are ganged together across at least the width of machine 10. Typically, the tires are independently suspended in pairs such that each gang of tires may follow the contours of the underlying surface to compact the aerated asphalt in layer 24. Typically, the front and rear elements contain differing numbers of tires, for example, five and six tires, and are laterally staggered by half a tire width such that all of surface 22 is covered in a single pass of machine 10. Typically, machine 10 is also provided with substantial dead weight (not shown) distributed appropriately on chassis 12 to assure proper weighting of the front and rear elements. To enhance the dead weight of the overall machine, it is known to fill the tires with water or saline solution.

When prior art machine 10 is a smoothing machine, front element 18 and rear element 20 each comprise one or more smooth-surfaced steel rollers extending across at least the width of machine 10. The steel rollers work the previously-compacted asphalt layer 24 both forth and back and laterally to eliminate depressions and thus provide an overall even layer. In addition, the steel rollers intensely compact the upper part of the layer to impart a very fine-grained finish to the surface 22 of layer 24.

Figure 2:
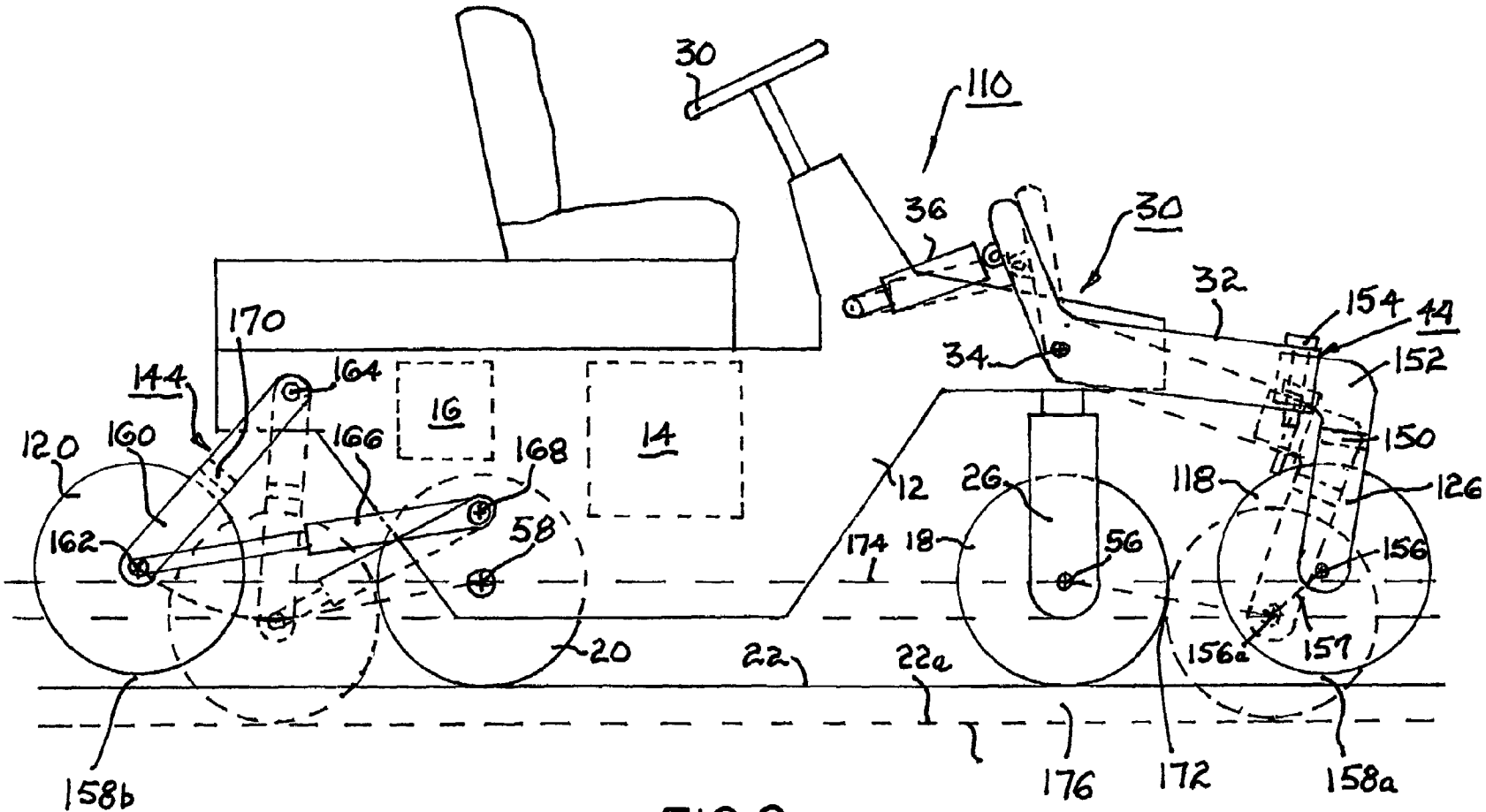
FIG. 2 is an elevational side view of a combination compacting and smoothing finishing machine in accordance with the invention.

Referring now to FIG. 2, a combination asphalt compacting and smoothing machine 110 in accordance with the present invention has elements in common with prior art machine 10 which are commonly numbered. In addition, front and rear rollable elements 18,20 are to be considered as primary elements. The primary elements and features are shown in solid lines, and secondary elements and features are shown in dashed lines. Thus, machine 110 is shown in FIG. 2 in primary-element mode wherein the primary front and rear elements 18,20 are in contact with asphalt surface 22.

At the front of machine 110, a secondary front rollable element 118 is mounted on a secondary fork 126 attached via a yoke 150 to an angle arm 152 that is pivotably connected to lever arm 32 (defining thereby a front pivotable arm) via a generally vertical hinge pin 154. Primary front element 18 may be either of a gang of compacting rubber tires or a smoothing steel roller; and secondary front element 118 is the counterpart thereof, being either of a smoothing steel roller or a gang of compacting rubber tires, respectively.

In first position 44, the axis 156 of secondary front element 118 is higher than the axis 56 of primary front element 18 such that the front portion of machine 110 is supported on surface 22 by primary front element 18, and secondary front element 118 is separated from surface 22 by a front gap 158*a*.

Similarly, at the rear of machine 110, a secondary rear rollable element 120 is mounted on a rear pivotable arm 160 at a pivot axis 162, the rear pivotable arm being pivotably connected to chassis 12 at pivot 164. A hydraulic cylinder 166 operationally connected to hydraulic pump 16 is pivotably connected to secondary element 120 at pivot axis 162 and is pivotably connected to chassis 12 at pivot axis 168. Primary rear element 20 may be either of a gang of compacting rubber tires or a smoothing steel roller; and secondary rear element 120 is the counterpart thereof, being either of a smoothing steel roller or a gang of compacting rubber tires, respectively. Preferably, a second set of components comprising a second rear pivotable arm 160 and a second hydraulic cylinder 166 is similarly disposed on the opposite side of machine 110 (not visible in FIG. 2) and are connected by yoke 170 extending horizontally therebetween.

In a first position 144, the axis 162 of secondary rear element 120 is higher than the axis 58 of primary rear element 20 such that the rear portion of machine 110 is supported on surface 22 by primary rear element 20, and secondary rear element 120 is separated from surface 22 by a rear gap 158*b*, which may be the same size as front gap 158*a*.

In the configuration as described thus far, machine 110 functions substantially identically with prior art machine 10, being borne on the primary front and rear rollable elements 18,20, whether the front and rear primary elements 18,20 are compacting rubber tires or smoothing steel rollers.

A principal advantage of improved machine 110 over prior art machine 10 is that improved machine 110 may function as either a compacting machine or a smoothing machine by switching alternatively between a primary-element mode and a secondary-element mode.

As is seen in FIG. 1, extending of hydraulic cylinder 36 drives the outer end 42 of lever arm 32 from the "up" position 44 to the "down" position 46. Such movement is seen in FIG. 2 to drive secondary element axis 156 along arc 157 to a new position 156*a* that is lower than axis 56 of primary front element 26. In so doing, secondary front element 118 engages primary front element 18 at a nip point 172 below the horizontal equatorial level 174 of axis 56. In this way, secondary front element 126 raises primary front element 18 from contact with surface 22 and becomes instead the load-bearing element for the front portion of machine 110 and is driven by friction with surface 22, shown herein as surface 22*a*. (Note: it will be recognized that the elevation of surface 22 does not change, but rather the machine is raised by a height 176; however, for purposes of illustration herein, the surface is lowered rather that the machine being raised. Note further that in a machine wherein both the front and rear elements are positively driven by the engine, the front primary and secondary elements must counter-rotate, and thus in the secondary-element mode, "forward" and "reverse" of the machine are reversed.)

Considering now the rear portion of machine 110, contraction of hydraulic cylinder 166 drives secondary rear element axis 162 along arc 178 to a new position 162*a* that is lower than axis 58 of primary rear element 20. In so doing, secondary rear element 120 engages primary rear element 20 at a nip point 180 below the horizontal equatorial level 174 of axis 58. In this way, secondary rear element 120 raises primary rear element 20 from contact with surface 22 by height 176 and becomes instead the load-bearing element for the rear portion of machine 110 and is driven by frictional contact with primary rear element 20 which remains driven by engine 14. (Note as with the front elements that the rear primary and secondary elements also must counter-rotate.)

In secondary-element mode, the distance between the secondary front and rear element axes 156*a*,162*a* is less than the distance between the primary front and rear element axes 56,162, thus causing machine 110 to be borne solely on the secondary front and rear elements 118,120, through weight-bearing contact with the primary front and rear elements 18,20, respectively. Return to primary-element mode is the reverse.

The invention as described thus far is applied to a paving machine having a gang of compacting rubber tires or a smoothing steel roller means at both the front and the rear portions of the machine. However, it is well known in the prior art that paving machines alternatively may be constructed having either of a gang of compacting rubber tires or a smoothing steel roller disposed only at either a front portion or a rear portion of the machine. It should be understood that the combination of a gang of compacting rubber tires and a smoothing steel roller in alternative employment on a single machine as described herein is fully envisioned by the invention and is applicable to design and construction of single-roller machines.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A combination finishing machine for compacting and smoothing a layer of hot asphalt composition, comprising:

a) a chassis having a front end and a rear end;

b) an engine mounted on said chassis for motivation of said machine;

c) a hydraulic system mounted on said chassis;

d) a front primary roller element having a front primary roller axis and a rear primary roller element having a rear primary roller axis, both of said primary roller elements being mounted on said chassis and being supportive of said chassis for movement of said machine, wherein at least one of said primary roller elements is driven by said engine;

e) a front secondary roller element having a front secondary roller axis and being pivotably mounted on said chassis via at least one front pivotable arm;

f) a front hydraulic cylinder actuator operatively connected to said hydraulic system and pivotably mounted on said chassis and acting to selectively move said front roller element between first and second positions thereof, wherein said front secondary roller element is non-load-bearing of the weight of a front portion of said machine in said first position and is loadbearing of said weight of said front portion of said machine in said second position, and wherein in said second position said front secondary roller element is simultaneously in contact with said front primary roller element and with said layer of hot asphalt composition to bear said weight of said front portion of said machine in said second position via said front primary roller element;

g) a rear secondary roller element having a rear secondary roller axis and being pivotably mounted on said chassis via at least one rear pivotable arm; and h) a rear hydraulic cylinder actuator operatively connected to said hydraulic system and pivotably mounted on said chassis and acting to selectively move said rear secondary roller element between first and second positions thereof, wherein said rear secondary roller element is non-load-bearing of the weight of a rear portion of said machine in said first position and is loadbearing of said weight of said rear portion of said machine in said second position; and wherein in said second position said rear secondary roller element is simultaneously in contact with said rear primary roller element and with said layer of hot asphalt composition to bear said weight of said rear portion of said machine in said second position via said rear primary roller element.

2. A machine in accordance with claim 1 wherein said hydraulic system is powered by said engine.

3. A machine in accordance with claim 1 wherein said front primary roller element is selected from the group consisting of ganged tires and a steel roller.

4. A machine in accordance with claim 1 wherein said rear primary roller element is selected from the group consisting of ganged tires and a steel roller.

5. A machine in accordance with claim 1 wherein said front secondary roller element is selected from the group consisting of ganged tires and a steel roller.

6. A machine in accordance with claim 1 wherein said rear secondary roller element is selected from the group consisting of ganged tires and a steel roller.

7. A machine in accordance with claim 1 wherein said front primary roller element and said rear primary roller element are both steel rollers, and wherein said front secondary roller element and said rear secondary roller element are both ganged tires.

8. A machine in accordance with claim 1 wherein said front primary roller element and said rear primary roller element are both ganged tires and wherein said front secondary roller element and said rear secondary roller element are both steel rollers.

9. A machine in accordance with claim 1 wherein said rear hydraulic cylinder actuator is a first rear hydraulic cylinder actuator, and wherein said machine comprises a second rear hydraulic cylinder actuator operatively connected to said hydraulic system and pivotably mounted on a side of said chassis opposite the mounting side of said first rear hydraulic cylinder actuator and operable in tandem therewith.

10. A machine in accordance with claim 1 wherein said front primary roller element is pivotably connected to said chassis and is steerable, and wherein said rear primary roller element is driven by said engine.

11. A machine in accordance with claim 1 wherein both of said front primary roller element and said rear primary roller element are driven by said engine.

12. A machine in accordance with claim 1 wherein the distance between said front and rear primary roller axes is less than the distance between said front and rear secondary roller axes when said respective roller elements are in said first position, and wherein said distance between said front and rear primary roller axes is greater than said distance between said front and rear secondary roller axes when said respective roller elements are in said second position.

13. In an asphalt finishing machine having a pre-existing chassis having a front end and a rear end, a pre-existing engine mounted on the chassis for motivation of the machine, a pre-existing hydraulic system mounted on the chassis, a pre-existing front primary roller element having a front primary roller axis and a pre-existing rear primary roller element having a rear primary roller axis, wherein both of the primary roller elements are mounted on the chassis and are supportive of the chassis for movement of the machine, the improvement to said machine comprising:

a) a front secondary roller element having a front secondary roller axis and being pivotably mounted on said chassis via at least one front pivotable arm;

b) a front hydraulic cylinder actuator operatively connected to said hydraulic system and pivotably mounted on said chassis and acting to selectively move said front roller element between first and second positions thereof, wherein said front secondary roller element is non-loadbearing of the weight of a front portion of said machine in said first position and is loadbearing of said weight of said front portion of said machine in said second position, and wherein in said second position said front secondary roller element is simultaneously in contact with said front primary roller element and with said layer of hot asphalt composition to bear said weight of said front portion of said machine in said second position via said front primary roller element;

d) a rear secondary roller element having a rear secondary roller axis and being pivotably mounted on said chassis via at least one rear pivotable arm; and e) a rear hydraulic cylinder actuator operatively connected to said hydraulic system and pivotably mounted on said chassis and acting to selectively move said rear secondary roller element between first and second positions thereof, wherein said rear secondary roller element is non-loadbearing of the weight of a rear portion of said machine in said first position and is loadbearing of the weight of a rear portion of said machine in said second position; and wherein in said second position said rear secondary roller element is simultaneously in contact with said rear primary roller element and with said layer of hot asphalt composition to bear said weight of said rear portion of said machine in said second position via said rear primary roller element.

14. A combination finishing machine for compacting and smoothing a layer of hot asphalt composition, comprising:

a) a chassis having a front end and a rear end;

b) an engine mounted on said chassis for motivation of said machine;

c) a hydraulic system mounted on said chassis;

d) a front primary roller element having a front primary roller axis and a rear primary roller element having a rear primary roller axis, both of said primary roller elements being mounted on said chassis and being supportive of said chassis for movement of said machine, wherein at least one of said primary roller elements is driven by said engine;

e) a secondary roller element having a secondary roller axis and being pivotably mounted on said chassis via at least one pivotable arm; and f) a hydraulic cylinder actuator operatively connected to said hydraulic system and pivotably mounted on said chassis and acting to selectively move said secondary roller element between first and second positions thereof, wherein said secondary roller element is non-loadbearing of the weight of a portion of said machine in said first position and is loadbearing of said weight of said portion of said machine in said second position, and wherein in said second position said secondary roller element is simultaneously in contact with said primary roller element and with said layer of hot asphalt composition to bear said weight of said portion of said machine in said second position via said primary roller element.

* * * * *